US009148730B2

(12) United States Patent
Takano

(10) Patent No.: US 9,148,730 B2
(45) Date of Patent: Sep. 29, 2015

(54) ELECTROSTATIC SPEAKER

(71) Applicant: Yamaha Corporation, Hamamatsu-shi (JP)

(72) Inventor: Yasuaki Takano, Kikugawa (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/362,119

(22) PCT Filed: Nov. 29, 2012

(86) PCT No.: PCT/JP2012/080997
§ 371 (c)(1),
(2) Date: May 30, 2014

(87) PCT Pub. No.: WO2013/081078
PCT Pub. Date: Jun. 6, 2013

(65) Prior Publication Data

US 2014/0307897 A1 Oct. 16, 2014

(30) Foreign Application Priority Data

Nov. 30, 2011 (JP) ..... 2011-262774

(51) Int. Cl.
*H04R 1/00* (2006.01)
*H04R 19/01* (2006.01)
*H04R 19/02* (2006.01)
*H04R 31/00* (2006.01)

(52) U.S. Cl.
CPC ..... *H04R 19/01* (2013.01); *H04R 19/02* (2013.01); *H04R 31/006* (2013.01); *Y10T 29/49005* (2015.01)

(58) Field of Classification Search
CPC ..... H04R 19/01; H04R 19/02; H04R 31/006
USPC ..... 381/190–191; 181/167, 170
See application file for complete search history.

(56) References Cited

U.S. PATENT DOCUMENTS

| | | | | |
|---|---|---|---|---|
| 2009/0058228 | A1* | 3/2009 | Wakabayashi et al. | 310/334 |
| 2009/0087002 | A1* | 4/2009 | Nakaya et al. | 381/191 |
| 2009/0151984 | A1* | 6/2009 | Fujimura | 174/250 |

FOREIGN PATENT DOCUMENTS

| | | | |
|---|---|---|---|
| JP | 09-085911 | A | 3/1997 |
| JP | 2005-198342 | A | 7/2005 |
| JP | 2009-206758 | A | 9/2009 |
| JP | 2010-068053 | A | 3/2010 |

OTHER PUBLICATIONS

International Search Report mailed Jan. 8, 2013, for International Application No. PCT/JP2012/080997, with English translation, three pages.

* cited by examiner

*Primary Examiner* — Curtis Kuntz
*Assistant Examiner* — Katherine Faley
(74) *Attorney, Agent, or Firm* — Morrison & Foerster LLP

(57) ABSTRACT

An electrostatic speaker includes: an oscillator; a first cushioning material layer and a second cushioning material layer; a first electrode and a second electrode; and a first cover layer and a second cover layer. In a second region inside a first region including an outer edge end of a laminated body including a plurality of layers including at least the first cover layer and the second cover layer, two adjacent layers of the plurality of layers included in the laminated body are fixed to each other, and strength at the outer edge end in the first region is higher than strength in the second region.

6 Claims, 7 Drawing Sheets

ELECTROSTATIC SPEAKER

CROSS-REFERENCE TO RELATED APPLICATIONS

This application is a National Phase application under 35 U.S.C. §371 of International Application No. PCT/JP2012/080997 filed Nov. 29, 2012, which claims the priority benefit of Japanese Patent Application No. 2011-262774 filed Nov. 30, 2011, the contents of which are hereby incorporated by reference in their entireties for all intended purposes.

TECHNICAL FIELD

The present invention relates to an electrostatic speaker.

BACKGROUND ART

Electrostatic speakers are attracting attention as speakers capable of generating sound with high straight forwardness by emitting plane waves.

An electrostatic speaker has a structure in which, on each side of a sheet-like oscillator having conductivity, a sheet-like electrode having conductivity is disposed with an insulating spacer held therebetween. The electrode is required to be equipped with numerous through-holes passing through the inside and outside faces thereof and serving as air moving paths so as not to obstruct the oscillation of the oscillator, and the electrode is made of, for example, a cloth woven from conductive fibers or a punching metal sheet.

When a direct-current bias voltage is applied between the oscillator and each of the two electrodes, and an alternate-current voltage drive signal corresponding to a sound waveform is applied between the two electrodes, a drive force corresponding to the drive signal is generated between the oscillator and the electrode in accordance with Coulomb's law, and the oscillator oscillating between the two electrodes by virtue of the drive force generates sound pressure. As a result, sound corresponding to the sound waveform is emitted.

For the purpose oscillating the oscillator between the two electrodes, each of the two electrodes is required to be disposed so as to be isolated from the oscillator. Hence, a cushioning material layer having insulation property, air permeability and elasticity is disposed between the oscillator and each of the two electrodes. As the cushioning material layer, for example, a nonwoven cloth made of PET (polyethylene terephthalate) can be used.

In the case that a laminated body formed of a plurality of sheet-like members, in which the cushioning material layer is disposed on each side of the oscillator and the electrode is disposed on each outside thereof as describe above, is exposed directly to the outside, the user may touch the electrode and receive an electric shock or dust may attach to the electrode or the oscillator, thereby inducing discharge or leakage between the electrode and the oscillator. For the purpose of avoiding these problems, a cover layer is usually disposed on the outside of each of the two electrodes. As the cover, for example, a PET film can be used. Since the PET film also has waterproofness, the film can prevent intrusion of not only dust but also liquid and moisture to the inside and can also prevent corrosion or the like of the electrodes and the conductive layer of the oscillator.

Since the above-mentioned cover layer is easily broken when the layer collides with a pen tip or the like or makes contact with a high-temperature lamp or the like, an outside cover having flame retardant property and cushioning property is disposed in some cases further outside the above-mentioned cover layer. As the outside cover to be used for such a purpose, for example, a flame-retardant nonwoven cloth can be used.

The above-mentioned cover layer is required to be formed into a bag-like shape to protect the electrodes and the oscillator to be accommodated therein. At the time, the cover layer is required to be air tight to hold therein an air layer required for the oscillation of the oscillator and to prevent intrusion of moisture or the like from the outside to the inside.

As widely spread techniques for fixing a plurality of laminated synthetic resin sheets so that the outer edge regions thereof are sealed with one another, a method in which the sheets are bonded using an adhesive and a method in which welding is performed between the sheets by heating and melting and then by cooling the synthetic resin, that is, heat sealing (heat welding), are available.

In the case of using an adhesive, a process of applying the adhesive to one sheet, quickly positioning the other sheet and disposing the other sheet on the sheet on which the adhesive has been applied, pressing the adhesion portions thereof and waiting for the adhesive to be hardened is performed, whereby the process is complicated and takes time. Furthermore, for the purpose of fixing all the n sheets of the laminated body using the adhesive, the above-mentioned process is required to be performed (n−1) times.

On the other hand, in the case of heat sealing, a belt-like heater is pressed against previously positioned and laminated sheets to heat them, whereby fixing between the sheets is completed. The time required for the melted synthetic resin to be cooled and hardened is generally shorter than the hardening time of the adhesive, and the process required for fixing all the n sheets of the laminated body is the same as the process for fixing two sheets, whereby the heater is merely required to be pressed once against the sheets to heat them. Hence, generally, heat sealing is low in cost as a method for fixing the synthetic resin sheets of the laminated body to one another in comparison with the case in which the adhesive is used.

A technique for performing welding between synthetic resin sheets by heat sealing is disclosed, for example, in Patent Document 1. In Patent Document 1, a technique has been proposed to reduce sealing defects in heat sealing by specifying the difference between the crystal melting points of two synthetic resin layers to be welded to each other, the thickness of the synthetic resin layer having a lower crystal melting point, and the optimal value of the thickness ratio of the layers.

PRIOR ART DOCUMENT

Patent Document

Patent Document 1: JP-A-9-85911

GENERAL DESCRIPTION OF THE INVENTION

Problem that the Invention is to Solve

In comparison with, for example, dynamic speakers having been widely spread, electrostatic speakers have a structure in which the thickness thereof is made small easily. A foldable or rollable sheet-like speaker can also be produced, for example, by forming all of the oscillator, the cushioning material layers, the electrodes, the waterproof layers and the cover layers thereof using thin flexible sheets.

A sheet-like speaker can be used, for example, as an advertisement medium appealing audio-visually by printing an advertisement image on the cover layer thereof and by guiding an advertisement content by voice. In such a use, the speaker itself is required to be replaced in order that an advertisement, the effect of which has lowered, is replaced. Hence, a sheet-like electrostatic speaker that is particularly used for such a use is required to be low in cost.

Heat sealing is excellent as a low cost method for fixing the outer edge portions of synthetic resin sheets, such as laminated cushioning material layers, waterproof layers and cover layers, to one another and for forming the sheets into a sealed bag-like shape.

However, in the case that the synthetic resin sheets are melted and cooled by heat sealing, the fiber structure of each sheet, being present before melting, is lost or the strength thereof is lost due to stretching, and the sheets having been in a plurality of layers are formed into a single layer, whereby the bending strength and the tensile strength in the sealed region are lowered in many cases. Hence, in the case that the outer edge portions of the synthetic resin sheets constituting an electrostatic speaker are sealed and fixed by heat sealing, there occurs a problem that the sealed outer edge portions are liable to be broken due to external impacts or the like accompanied by the use of the electrostatic speaker.

For the purpose of solving this problem, it is considered to use, for example, a method in which, between two sheets to be fixed to each other, a sheet having a melting point lower than the melting point of the two sheets is held as an adhesive layer, and heat sealing is performed at a temperature lower than the melting point of the two sheets to be fixed and higher than the melting point of the adhesive layer. In that case, only the adhesive layer is melted and fixed to the two sheets with which both sides of the adhesive layer make contact, whereby the two sheets to be fixed are fixed to each other via the adhesive layer.

However, in the case that the adhesive layer is used in heat sealing, there is a problem that the thickness of the whole laminated body increases by the thickness of the adhesive layer, and the cost of the whole laminated body increases by the cost of the adhesive layer. Furthermore, since the adhesive layer is added to the laminated body, the emission of the sound generated by the oscillator is obstructed and acoustic characteristics are degraded. Hence, the fixing of the laminated body using the adhesive layer is not suitable for the production of an electrostatic speaker that is required to be low in cost and thin in thickness and to reproduce high-quality sound.

The present invention has been made under the above-mentioned background and it is an object of the present invention to provide means for reducing breakage due to deterioration in the strength of fixed portions occurring when a laminated body formed of synthetic resin sheets constituting an electrostatic speaker is sealed and fixed in the outer edge region thereof.

Means for Solving the Problem

For the purpose of solving the above-mentioned problems, the present invention provides an electrostatic speaker comprising: an oscillator formed of a sheet-like member and having conductivity and flexibility; a first cushioning material layer and a second cushioning material layer, each formed of a sheet-like member and having insulation property, air permeability and elasticity; a first electrode and a second electrode, each formed of a sheet-like member and having conductivity, air permeability and flexibility; and a first cover layer and a second cover layer, each formed of a sheet-like member and having insulation property, wherein the oscillator is disposed between the first cushioning material layer and the second cushioning material layer, the first cushioning material layer is disposed between the oscillator and the first electrode, and the second cushioning material layer is disposed between the oscillator and the second electrode, the first electrode is disposed between the first cushioning material layer and the first cover layer, and the second electrode is disposed between the second cushioning material layer and the second cover layer, in a second region inside a first region including an outer edge end of a laminated body including a plurality of layers including at least the first cover layer and the second cover layer, two adjacent layers of the plurality of layers included in the laminated body are fixed to each other, and strength at the outer edge end in the first region is higher than strength in the second region.

In the second region, the two adjacent layers of the plurality of layers included in the laminated body may be fixed to each other by heat sealing.

In the outer edge end in the first region, the two adjacent layers of the plurality of layers included in the laminated body may not be fixed.

The electrostatic speaker may further comprise a reinforcing layer formed of a sheet-like member and fixed to at least one layer of the plurality of layers included in the laminated body, in at least part of the first region.

The first region may include the whole periphery of the outer edge end of the laminated body.

For the purpose of solving the above-mentioned problems, the present invention provides an electrostatic speaker producing method comprising: providing an electrostatic speaker comprising: an oscillator formed of a sheet-like member and having conductivity and flexibility; a first cushioning material layer and a second cushioning material layer, each formed of a sheet-like member and having insulation property, air permeability and elasticity; a first electrode and a second electrode, each formed of a sheet-like member and having conductivity, air permeability and flexibility; and a first cover layer and a second cover layer, each formed of a sheet-like member and having insulation property, wherein the oscillator is disposed between the first cushioning material layer and the second cushioning material layer, the first cushioning material layer is disposed between the oscillator and the first electrode, and the second cushioning material layer is disposed between the oscillator and the second electrode, and the first electrode is disposed between the first cushioning material layer and the first cover layer, and the second electrode is disposed between the second cushioning material layer and the second cover layer; and, in a second region inside a first region including an outer edge end of a laminated body including a plurality of layers including at least the first cover layer and the second cover layer, fixing two adjacent layers of the plurality of layers included in the laminated body to each other, wherein strength at the outer edge end in the first region is higher than strength in the second region.

Advantage of the Invention

With the present invention, when the outer edge region of the laminated body including the cover layers constituting the electrostatic speaker is sealed and fixed, even if deterioration in strength occurs in the fixed region, a region having high strength is provided outside the region in which the deterioration in strength has occurred, whereby the outer edge end portion liable to be subjected to an external impact is not broken easily.

MODE FOR CARRYING OUT THE INVENTION

Embodiment

Figure 1:
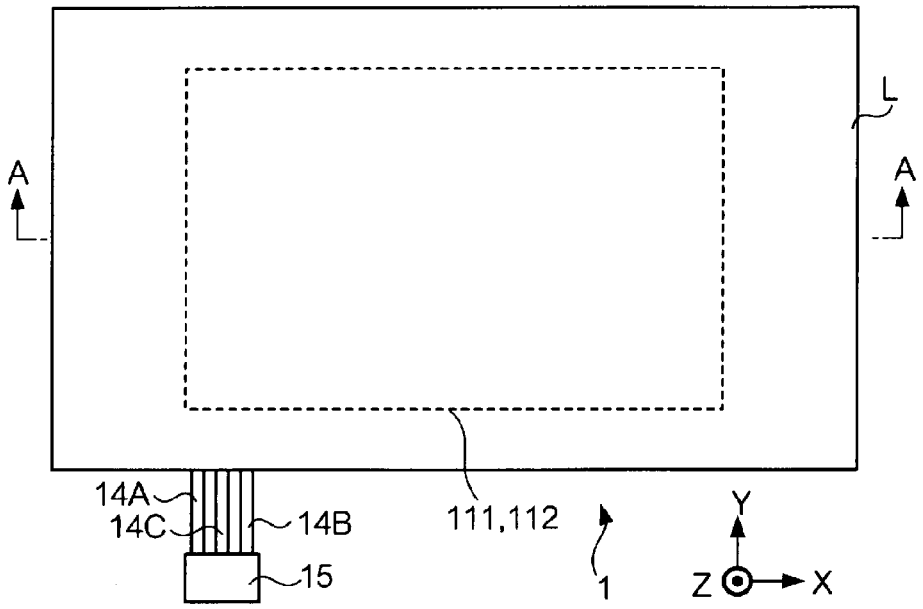
FIG. 1 is a top view showing an electrostatic speaker according to an embodiment of the present invention.
Figure 2:
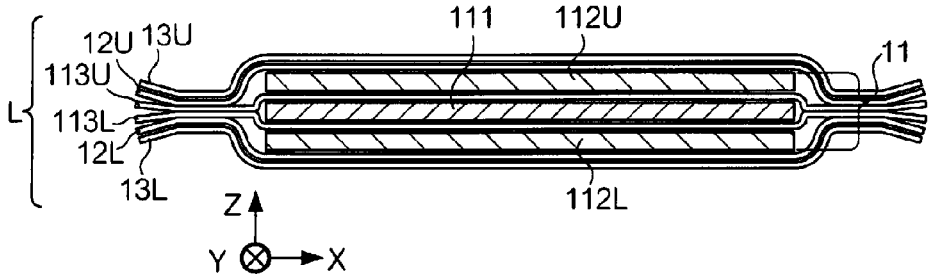
FIG. 2 is a cross-sectional view showing the electrostatic speaker according to the embodiment of the present invention.

FIG. 1 is a top view showing an electrostatic speaker 1 according to an embodiment of the present invention, and FIG. 2 is a cross-sectional view taken on line A-A of FIG. 1.

In FIGS. 1 and 2, directions are indicated by X, Y and Z axes being orthogonal to one another; when the cross-section of the electrostatic speaker 1 shown in FIG. 2 is viewed from the front, the left-right direction is set as the X axis, the depth direction is set as the Y axis, and the height direction is set as the Z axis. Furthermore, it is assumed that the sign in the drawing, indicated by "•" placed in "○", denotes an arrow directed from the back to the front of the drawing. Moreover, it is assumed that the sign in the drawing, indicated by "x" placed in "○", denotes an arrow directed from the front to the back of the drawing.

Besides, the dimensions of the respective members shown in the drawing are made different from their actual dimensions so that the shapes and positional relationships of the respective members can be understood easily; in particular, the lengths in the height direction (the direction of the Z axis) are shown longer than their actual lengths.

As shown in FIGS. 1 and 2, the electrostatic speaker 1 is equipped with a sound emitting part 11 that is driven by voltage applied from a drive circuit 2 (described later) to emit sound; an inside cover 12 and an outside cover 13 for accommodating the sound emitting part 11; three cables 14 (a cable 14A, a cable 14B and a cable 14C) serving as lead wires for electrically connecting the drive circuit 2 to the sound emitting part 11; and a connector 15 that is engaged with a connector 24 (described later) provided for the drive circuit 2 to establish an electrical connection between the cables 14 and the drive circuit 2.

The sound emitting part 11 is equipped with an oscillator 111; an electrode 112U and an electrode 112L disposed above and below the oscillator 111, respectively; and a cushioning material layer 113U and a cushioning material layer 113L disposed between the oscillator 111 and the electrode 112U and between the oscillator 111 and the electrode 112L, respectively. In other words, the electrode 112U is disposed so as to be separated from the oscillator 111 by the cushioning material layer 113U, and the electrode 112L is disposed so as to be separated from the oscillator 111 by the cushioning material layer 113L.

As in the electrode 112U and the electrode 112L, it is indicated that members having the same number (or number+ lowercase alphabet letter) to which "U" or "L" is added are members having the same configuration, and that the member with "U" is the member disposed on the upper side in FIG. 1 and the member with "L" is the member disposed on the lower side in FIG. 1. In addition, in the case that it is not necessary to distinguish the member with "U" from the member with "L", the member is simply written as, for example, "electrode 112", by omitting "L" and "U".

Of the members constituting the sound emitting part 11, the oscillator 111 and the electrode 112 are almost the same in size and shape as viewed from the Z-axis direction. On the other hand, although the cushioning material layer 113U and the cushioning material layer 113L are common to the oscillator 111 and the electrode 112 in that they have an almost rectangular shape as viewed from the Z-axis direction, their lengths in the X-axis direction and the Y-axis direction are longer than the lengths of the oscillator 111 and the electrode 112.

The oscillator 111 and the electrode 112 are positioned by being bonded with an adhesive to the cushioning material layers 113 making contact therewith in the vertical direction around the whole peripheries of their outer edge portions, that is, in belt-like regions having a predetermined width from their outer-edge end portions in the X-axis direction and in regions having a predetermined width from their outer-edge end portions in the Y-axis direction.

The oscillator 111 is a sheet-like member on which a conductive layer is formed by evaporating conductive metal, such as aluminum, on one face of a synthetic resin film (insulation layer) having insulation property and flexibility and made of, for example, PET or PP (polypropylene), and having an almost rectangular shape as viewed from the Z-axis direction.

Like the oscillator 111, the electrode 112 is a sheet-like member on which a conductive layer is formed by evaporating conductive metal, such as aluminum, on one face of a synthetic resin film (insulation layer) having insulation property, made of, for example, PET or PP, and having an almost rectangular shape as viewed from the Z-axis direction.

Unlike the oscillator 111, the electrode 112 is provided with numerous through-holes passing through the front and back faces thereof. These through-holes function as paths through which air moves mainly in the Z-axis direction in accordance with the oscillation of the oscillator 111.

The cushioning material layer 113 is a sheet-like PET nonwoven cloth having an almost rectangular shape as viewed from the Z-axis direction and having insulation property and is configured so that air can move between one face and the other face thereof via voids formed among the numerous fibers thereof extending in indefinite directions. In addition, the cushioning material layer 113 has elasticity, thereby being deformed when a force is applied from the oscillator 111 in accordance with the oscillation of the oscillator 111 and returning to its original shape when the force is removed.

The inside cover 12 is a synthetic resin sheet having waterproofness and moisture proofness, such as a PET film, having an almost rectangular shape as viewed from the Z-axis direction. The size and shape of the inside cover 12 as viewed from the Z-axis direction is almost the same as the size and shape of the cushioning material layer 113. The inside cover 12 mainly plays a role of preventing intrusion of liquid and moisture to the sound emitting part 11.

The outside cover 13 is a synthetic resin sheet having flame retardant property and cushioning property, such as a flame-retardant nonwoven cloth having an almost rectangular shape as viewed from the Z-axis direction. The size and shape of the outside cover 13 as viewed from the Z-axis direction is almost the same as the size and shape of the cushioning material layer 113. The outside cover 13 mainly plays a role of protecting the inside cover 12 and the sound emitting part 11 against external impacts.

As describe above, the cushioning material layer 113, the inside cover 12 and the outside cover 13 are almost the same in size and shape as viewed from the Z-axis direction, and these sheets are laminated in the order of the outside cover 13L, the inside cover 12L, the cushioning material layer 113L, the cushioning material layer 113U, the inside cover 12U and the outside cover 13U from the lower side to the upper side in FIG. 2. These laminated sheets are hereafter referred to as a laminated body L. In the outer edge region of the laminated body L, each of the sheets makes direct contact with the other sheet adjacent thereto; however, in the inside region thereof, the electrode 112L is held between the inside cover 12L and the cushioning material layer 113L, the oscillator 111 is held between the cushioning material layer 113L and the cushioning material layer 113U, and the electrode 112U is held between the cushioning material layer 113U and the inside cover 12U, whereby the electrodes are opposed to each other.

In the case of the laminated body L including the cushioning material layers 113, the inside covers 12 and the outside covers 13, in a rectangular belt-like region (rectangular region) having a predetermined width and formed around the whole periphery inside the outer edge end thereof by a predetermined distance, two sheets adjacent to each other are melted, cooled and joined by heat sealing, thereby being integrated and fixed to each other.

Figure 3:
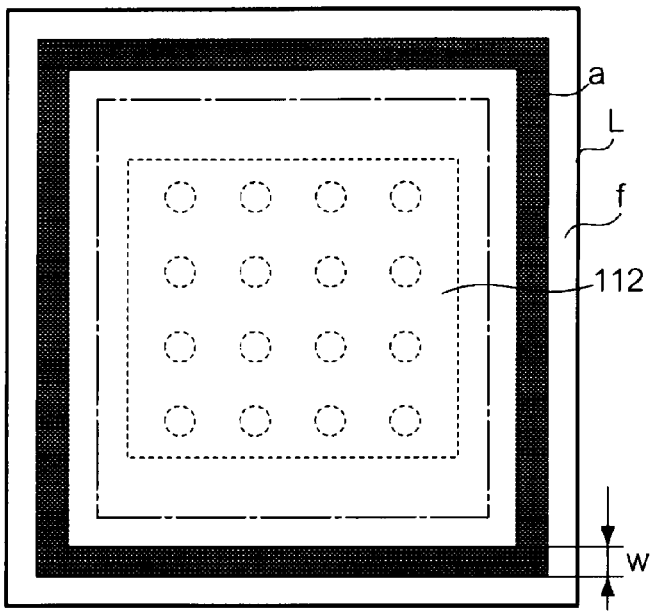
FIG. 3 is a view showing a region in which fixing using heat sealing is performed in the electrostatic speaker according to the embodiment of the present invention.

FIG. 3 is a view showing a region in which fixing using heat sealing is performed in the electrostatic speaker 1. In FIG. 3, the region in which the fixing using heat sealing is performed is indicated as a belt-like region a. The belt-like region a is a belt-like region having a rectangular shape as a whole and formed around the periphery with a predetermined width w inside an outer edge region f defined as a region between the whole periphery of the outer edge end of the laminated body L and the boundary line (the line indicated by a chain line in FIG. 3) positioned inside the outer edge end of the laminated body L by a predetermined distance from the whole periphery of the outer edge end. The outer edge end of the laminated body L is not required to be provided around the whole periphery thereof but may be provided for part of the whole periphery.

In the belt-like region a, the laminated body L is sealed (sealed and fixed) around the whole periphery thereof, and the oscillator 111 and the electrodes 112 accommodated therein are sealed water-tightly and air-tightly from the outside. Hence, dust, liquid, moisture, etc. do not enter the inside in which the sound emitting part 11 is accommodated.

In the portion of the belt-like region a of the laminated body L, the fiber structure provided for each sheet included in the laminated body L is melted and lost and further integrated with other sheets adjacent thereto, whereby the sheets are formed into a single layer as a whole. As a result, in comparison with the portions other than the belt-like region a of the laminated body L, the portion of the belt-like region a is low in bending strength and tensile strength.

However, in the electrostatic speaker 1, as shown in FIG. 3, the outer edge end of the belt-like region a is positioned inside the outer edge end of the laminated body L, and the portion of the belt-like region a in which deterioration in strength has occurred is not exposed to the outer edge end of the laminated body L. In other words, in the laminated body L, the fiber structures provided for the respective plurality of sheets included in the laminated body L are maintained at the outer edge end that is liable to be subjected to external impacts or the like, and the multi-layer structure in which the plurality of sheets are laminated is maintained, whereby breakage due to impacts or the like received from the outside does not occur easily.

Figure 4:
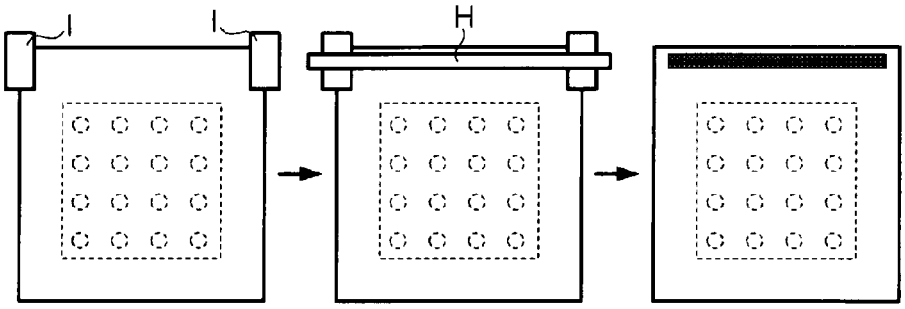
FIG. 4 is a view showing an example of a process for performing heat sealing for a laminated body according to the embodiment of the present invention.

FIG. 4 is a view showing an example of a process for performing heat sealing in the belt-like region a of the laminated body L. In the process exemplified in FIG. 4, first, one of the four sides of the laminated body L is selected, and a low heat conductive sheet I, such as a glass cloth or a SUS (stainless steel) plate, is placed from above at each of the corner portions positioned at both ends of the one side (refer to the left view in FIG. 4).

Next, a heat sealing heater H serving as a square column heater is positioned so that its longitudinal direction is oriented in parallel with the one side (the side, at both ends of which the low heat conductive sheets I are disposed) of the laminated body L and so that the heater extending in the longitudinal direction is positioned inside the laminated body L by a predetermined distance from the one side, and then pressure is applied from above to the laminated body L for a predetermined time (refer to the center view in FIG. 4).

Then, the heat sealing heater H and the low heat conductive sheets I are removed from the laminated body L, whereby heat sealing at the one side of the rectangular belt-like region a is completed (refer to the right view in FIG. 4).

Heat sealing in the belt-like region a, such a region as shown in FIG. 3, is completed by repeating the treatment in accordance with the above-mentioned process for each of the other three sides of the laminated body L.

Figure 5:
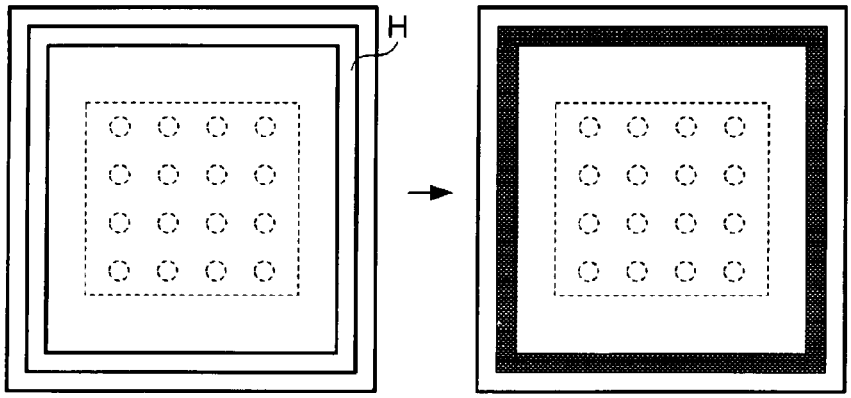
FIG. 5 is a view showing an example of another process for performing heat sealing for the laminated body according to the embodiment of the present invention.

FIG. 5 is a view showing an example of another process for performing heat sealing in the belt-like region a of the laminated body L. In the process exemplified in FIG. 5, a heat sealing heater H having a rectangular shape, each side of which has a predetermined width as viewed from the Z-axis direction, is used (refer to the left view in FIG. 5). After the heat sealing heater H was positioned with respect to the laminated body L, the heat sealing heater H is pressed against the laminated body L from above for a predetermined time, and then the heat sealing heater H is removed from the laminated body L. As a result, heat sealing in the belt-like region a, such a region as shown in FIG. 3, is completed (refer to the right view in FIG. 5).

Figure 6:
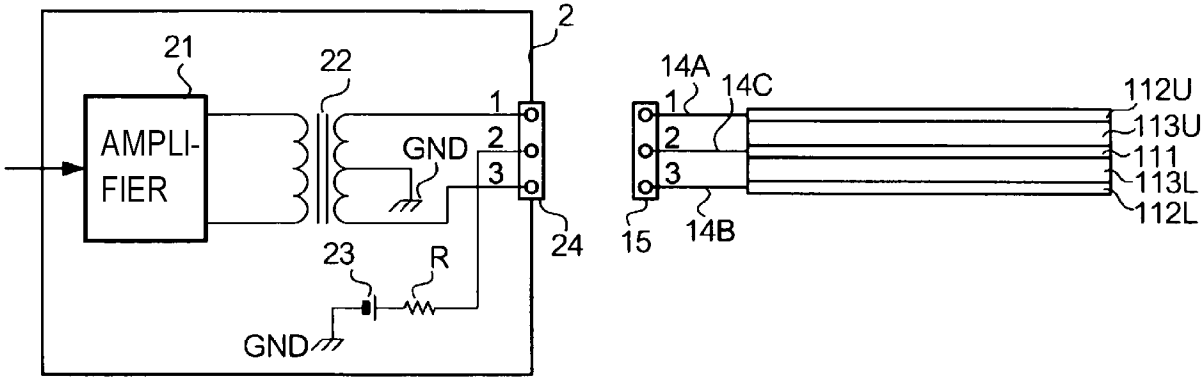
FIG. 6 is a view showing a drive circuit for driving the electrostatic speaker according to the embodiment of the present invention and showing the members for receiving voltages applied from the drive circuit in the members of the electrostatic speaker according to the embodiment of the present invention.

Referring to FIG. 1 again, the description of the members constituting the electrostatic speaker 1 will be continued. As described above, the electrostatic speaker 1 is equipped with the cable 14A, the cable 14B, the cable 14C and the connector 15 as members for receiving voltages applied from the drive circuit 2 to the sound emitting part 11. FIG. 6 is a view showing the drive circuit 2 for driving the electrostatic speaker 1 and showing the members for receiving voltages applied from the drive circuit 2 in the members of the electrostatic speaker 1.

As shown in FIG. 6, one end of the cable 14A is connected to the conductive layer of the electrode 112U accommodated in the cover 12, one end of the cable 14B is connected to the conductive layer of the electrode 112L accommodated in the cover 12, and one end of the cable 14C is connected to the conductive layer of the oscillator 111 accommodated in the cover 12. Furthermore, the other ends of the cable 14A, the cable 14B and the cable 14C are connected to the number 1 terminal, the number 3 terminal and the number 2 terminal of the connector 15, respectively.

As shown in FIG. 6, the drive circuit 2 is equipped with an amplifier 21, a transformer 22, a bias power source 23 and a connector 24.

The amplifier 21 is an apparatus for amplifying an alternate-current acoustic signal input from the outside and outputting the amplified signal, the output terminals of which are connected across the primary coil of the transformer 22. In other words, the alternate-current acoustic signal amplified by the amplifier 21 is supplied to the transformer 22.

The center tap of the secondary coil of the transformer 22 is connected to the ground GND of the drive circuit 2. Furthermore, one terminal of the secondary coil of the transformer 22 is connected to the number 1 terminal of the connector 24, and the other terminal thereof is connected to the number 3 terminal of the connector 24.

The bias power source 23 is a power source for applying a direct-current plus bias voltage to the oscillator 111, the minus side of which is connected to the ground GND of the drive circuit 2 and the plus side of which is connected to the number 2 terminal of the connector 24 via a resistor R serving as a protection resistor.

The connector 24 is engaged with the connector 15 of the electrostatic speaker 1, thereby establishing electrical connection between the drive circuit 2 and the electrostatic speaker 1. As described above, the one terminal of the transformer 22 is connected to the number 1 terminal of the connector 24, the other terminal of the transformer 22 is connected to the number 3 terminal thereof, and the bias power source 23 is connected to the number 2 terminal thereof via the resistor R.

When the connector 15 of the electrostatic speaker 1 and the connector 24 of the drive circuit 2 are engaged with each other, the terminals of the respective connectors, having the same number, are electrically connected to each other. As a result, the one terminal of the transformer 22 is connected to the conductive layer of the electrode 112U, the other terminal of the transformer 22 is connected to the conductive layer of the electrode 112L, and the bias power source 23 is connected to the conductive layer of the oscillator 111.

When the connector 15 and the connector 24 are engaged, a bias voltage, such as a predetermined direct-current plus voltage, is applied to the oscillator 111. In a state in which no acoustic signal is input to the drive circuit 2 from the outside, the voltage applied between the electrode 112U and the electrode 112L is 0 V.

When an alternate-current acoustic signal is input to the drive circuit 2, the input acoustic signal is amplified by the amplifier 21, supplied to the primary side of the transformer 22, stepped up in voltage by the transformer 22, and supplied to the electrode 112U and the electrode 112L. At the time, the acoustic signal supplied to the electrode 112U and the acoustic signal supplied to the electrode 112L are equal in amplitude but opposite in polarity.

In other words, when a plus acoustic signal is input to the amplifier 21, a plus voltage is applied to the electrode 112U, and a minus voltage having the same amplitude as that of the plus voltage is applied to the electrode 112L. In that case, the electrostatic attractive force between the oscillator 111 and the electrode 112U becomes weak, but the electrostatic attractive force between the oscillator 111 and the electrode 112L becomes strong. As a result, the oscillator 111 is displaced to the side of the electrode 112L (in the Z-axis negative direction) depending on the difference between the electrostatic attractive forces.

Furthermore, when a minus acoustic signal is input to the amplifier 21, a minus voltage is applied to the electrode 112U, and a plus voltage having the same amplitude as that of the minus voltage is applied to the electrode 112L. In that case, the electrostatic attractive force between the oscillator 111 and the electrode 112L becomes weak, but the electrostatic attractive force between the oscillator 111 and the electrode 112U becomes strong. As a result, the oscillator 111 is displaced to the side of the electrode 112U (in the Z-axis positive direction) depending on the difference between the electrostatic attractive forces.

As described above, the oscillator 111 is displaced repeatedly in the Z-axis positive and negative directions in accordance with the acoustic signal to be input to the amplifier 21 and thereby oscillates, whereby a sound wave in accordance with the oscillation state thereof (frequency, amplitude and phase) is emitted as sound from the oscillator 111.

The above description applies to the configurations and the operations of the electrostatic speaker 1 according to the embodiment of the present invention and the drive circuit 2 for driving the electrostatic speaker 1.

As described above, the sound emitting part 11 provided for the electrostatic speaker 1 is accommodated inside the laminated body L that is sealed from the outside by heat sealing around the whole periphery inside the outer edge region f. Since the treatment for sealing the laminated body L by heat sealing is low in cost in comparison with other treatments in which an adhesive or the like is used, the production cost of the electrostatic speaker 1 can be suppressed.

In addition, in the heat sealing of the laminated body L, for example, a low melting point adhesive layer is not required; hence, problems, such as high cost, deterioration in acoustic characteristics and increase in the thickness of the laminated body L in association with the addition of such an adhesive layer, are not caused in the electrostatic speaker 1.

Furthermore, although deterioration in strength occurs in the belt-like region a having been subjected to heat sealing, since the belt-like region a is not exposed to the outer edge end of the laminated body L, the electrostatic speaker 1 is not broken easily by external impacts or the like.

MODIFICATION

Although the embodiment according to the present invention has been described above, the present invention is not limited to the above-mentioned embodiment, but can be embodied with other various embodiments. For example, the above-mentioned embodiment may be modified as described below to embody the present invention. The above-mentioned embodiment and the following modifications may be combined variously to the extent that no contradiction occurs.

First Modification

Figure 7A:
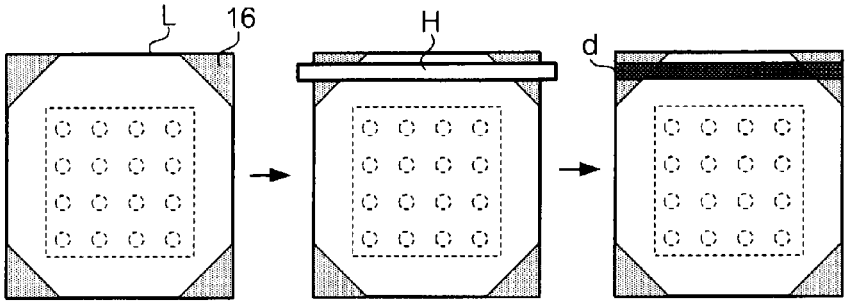
FIGS. 7(*a*) and 7(B) are views showing the process of heat sealing a laminated body according to a modification of the embodiment of the present invention and showing the configuration of the laminated body obtained as the result of the process.
Figure 7B:
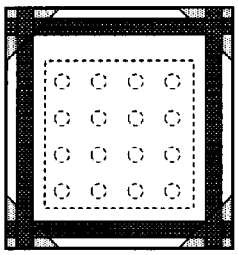

FIG. 7 is a view showing the process of heat sealing a laminated body L according to a first modification of the embodiment of the present invention and showing the configuration of the laminated body L obtained as the result of the process.

The laminated body L according to the first modification includes four glass cloths 16 in addition to the cushioning material layers 113, the inside covers 12 and the outside covers included in the laminated body L according to the above-mentioned embodiment.

Each of the four glass cloths 16 is a glass cloth formed into, for example, a right-angled isosceles triangle and is laminated inside the laminated body L, for example, between the cushioning material layer 113L and the cushioning material layer 113U so as to be disposed along each of the four corner portions of the laminated body L as viewed from the Z-axis direction (refer to the left view in FIG. 7(*a*)).

With respect to the laminated body L, at the corner portions of which the four glass cloths 16 are laminated as described above, a heat sealing heater H serving as a square column heater is positioned so that its longitudinal direction is oriented in parallel with one side of the laminated body L and so that the heater extending in the longitudinal direction is positioned inside the laminated body L by a predetermined distance from the one side, and then pressure is applied from above to the laminated body L for a predetermined time (refer to the center view in FIG. 7(*a*)).

Then, the heat sealing heater H is removed from the laminated body L, whereby heat sealing in the belt-like region extending between the two sides opposed to each other along the one side of the laminated body L is completed (refer to the right view in FIG. 7(*a*)).

Heat sealing in the belt-like region a having the parallelly crossing shape (hash mark shape) shown in FIG. 7(*b*) is completed by repeating the treatment in accordance with the above-mentioned process for each of the other three sides of the laminated body L.

In the case of the laminated body L according to Modification 1, in the belt-like region a in which heat sealing was performed and deterioration in strength has occurred, the end portion d shown in FIG. 7(*b*) is exposed to the outer edge end of the laminated body L. However, at the end portion d, the glass cloth 16 is disposed and the glass cloth 16 is not melted by heat sealing and has high strength, whereby deterioration in strength at the end portion d does not occur.

As a result, also in the case of the laminated body L according to the first modification, the electrostatic speaker 1 having high durability is realized at low cost without deterioration in acoustic characteristics.

In the laminated body L according to the first modification, the disposition position of the glass cloth 16 in the lamination direction of the laminated body L is not limited to the position between the cushioning material layer 113L and the cushioning material layer 113U, but the glass cloth 16 may be disposed, for example, between the cushioning material layer 113U and the inside cover 12U, between the inside cover 12U and the outside cover 13U, or outside the outside cover 13U.

Furthermore, two or more glass cloths 16 may be disposed in the lamination direction of the laminated body L. However, the addition of the glass cloths 16 increases the thickness at the corner portions of the laminated body L and also increases cost; hence, in the case that sufficient strength is obtained using a single layer of the glass cloth 16, the number of the glass cloths 16 in the lamination direction of the laminated body L is desired to be smaller.

Moreover, instead of the glass cloth 16, a sheet-like member made of a material other than a synthetic resin, that is, a material higher in melting point and strength than those of a synthetic resin may also be adopted.

Second Modification

Figure 8A:
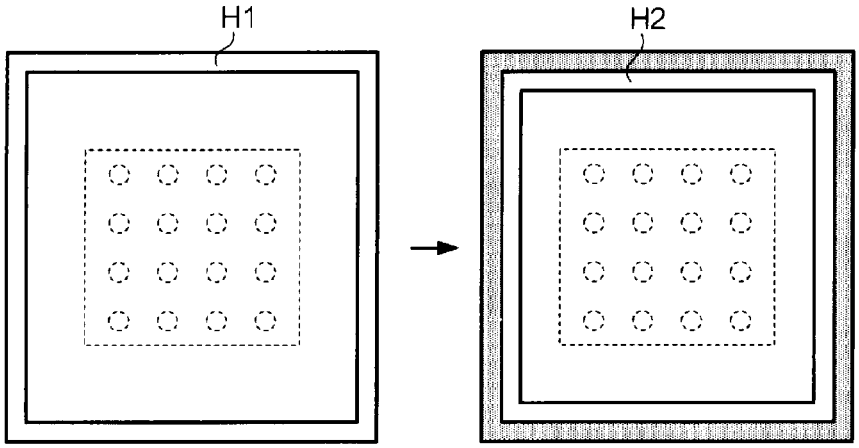
FIGS. 8 (*a*) and 8(B) are views showing the process of heat sealing a laminated body according to another modification of the embodiment of the present invention and showing the configuration of the laminated body obtained as the result of the process.
Figure 8B:
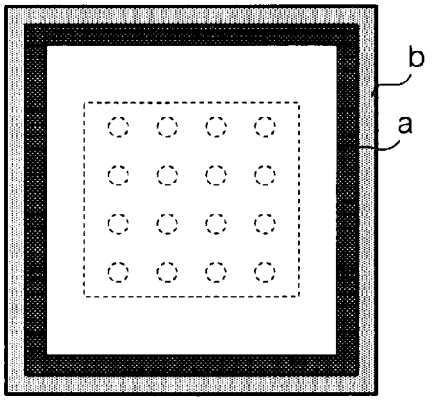

FIG. 8 is a view showing the process of heat sealing a laminated body L according to a second modification of the embodiment of the present invention and showing the configuration of the laminated body L obtained as the result of the process.

In addition to the sealing in the belt-like region a, the laminated body L according to the second modification is subjected to sealing in a belt-like region b outside the belt-like region a of the laminated body L (FIG. 8(*b*)). The sealing in the belt-like region b is performed at a temperature lower than that for the sealing in the belt-like region a. Hence, in the belt-like region b, the fiber structures of the plurality of sheets included in the laminated body L are partly maintained, and the surface regions of the sheets adjacent to each other are partly welded between the sheets; however, a state in which a plurality of layers are laminated is maintained in at least part of the regions.

As a result, although the sealing performance in the belt-like region b is lower than that of the belt-like region a, the strength in the belt-like region b is maintained substantially equivalent to the strength in the regions other than the belt-like region a of the laminated body L. Hence, also in the case of the laminated body L according to the second modification, the electrostatic speaker 1 having high durability is realized at low cost without deterioration in acoustic characteristics.

Since the laminated body L according to the second modification requires two times the number of processes for heat sealing in comparison with the laminated body L according to the above-mentioned embodiment as described below, the laminated body L is inferior to the laminated body L according to the above-mentioned embodiment in cost; however, since the outer edge portion of the laminated body L is formed into a single bundle of laminated body, excellent characteristics, such as being desirable in appearance and making dust or the like hard to attach to the outer edge portion of the laminated body L, are obtained.

The laminated body L according to the second modification is produced, first by pressing a rectangular heat sealing heater H1, each side of which has a predetermined width, against the belt-like region b for a predetermined time (the left view in FIG. 8(*a*)), and then by pressing a rectangular heat sealing heater H2, which is smaller in size than the heat sealing heater H1 and each side of which has a predetermined width, against the belt-like region a for a predetermined time at a temperature higher than that of the heat sealing heater H1 (the right view in FIG. 8 (*a*)).

In the above-mentioned production processing, the order of the heat sealing process for the belt-like region b and the heat sealing process for the belt-like region a may be reversed. Furthermore, the heat sealing process for the belt-like region b and the heat sealing process for the belt-like region a may be performed simultaneously by using a heat sealing heater having a structure in which the heat sealing heater H1 is disposed outside the heat sealing heater H2.

Furthermore, in the above-mentioned second modification, the temperature in the belt-like region a is made different from the temperature in the belt-like region b, whereby the degree of deterioration in strength is made different between the regions; however, for example, in addition to or instead of the difference in temperature, by making the pressing time and pressing intensity different between the heat sealing heaters, a process may also be adopted in which the degree of deterioration in strength is made different between the two regions.

Moreover, in the above-mentioned second modification, the region to be subjected to heat sealing is divided into two regions, that is, the belt-like region a and the belt-like region b; however, the region may be divided into three or more regions, or without providing any clear boundary line between the belt-like region a and the belt-like region b, a configuration in which the strength increases continuously from the inside to the outside may also be adopted. A laminated body L having such a configuration is produced, for example, by performing heat sealing for the laminated body L using a heat sealing heater having a rectangular heating section, each side of which has a predetermined width and which covers the belt-like region a and the belt-like region b, and being configured so that the heating temperature thereof lowers from the inside to the outside.

Other Modifications

Although the modifications relating to the configuration of the laminated body L has been described above, also with respect to the other constituent members of the electrostatic speaker 1, various configurations different from those adopted in the above-mentioned embodiment can also be adopted in the electrostatic speaker according to the present invention. For example, the materials, etc. of the oscillator 111, the electrode 112, the cushioning material layer 113, the inside cover 12 and the outside cover 13 are not limited to those described above, but any materials may also be adopted within a range not damaging their functions.

In addition, in the above-mentioned embodiment and modifications, heat sealing is adopted as a method for sealing and fixing the laminated body L in the belt-like region a; however, in the present invention, without being limited to the method, any fixing methods, in which, when sealing and fixing are performed among a plurality of synthetic resin sheets, deterioration in strength occurs in the fixed portions, can be adopted as sealing and fixing methods in the production of the laminated body provided for the electrostatic speaker according to the present invention.

For example, also in the case of sealing and fixing using a type of adhesive, the adhesive dissolves synthetic resin sheets to be bonded, whereby the sheets are integrated into a single layer and deterioration in strength occurs in some cases. Furthermore, in the case of a type of adhesive that lacks flexibility after hardening, the hardened adhesive is broken when the electrostatic speaker 1 is bent or rolled, whereby the laminated body L is broken in some cases. Even in the case of sealing and fixing the laminated body L using these adhesives, the durability of the electrostatic speaker 1 can be maintained by disposing the region to be fixed inside the outer edge ends of the laminated body L.

Moreover, in the above-mentioned embodiment and modifications, of the plurality of synthetic resin sheets constituting the electrostatic speaker 1, the cushioning material layer 113, the inside cover 12 and the outside cover 13 are used as sheet-like members to be sealed and constitute the laminated body L; however, the present invention is not limited in this respect. Hence, for example, an electrostatic speaker 1 may be adopted in which the cushioning material layer 113 that is not necessarily required to be sealed and fixed is configured so that its size and shape as viewed from the Z-axis direction are almost the same as the size and shape of the oscillator 111 and the electrode 112, whereby the cushioning material layer 113 is excluded from the constituent members of the laminated body L, and only the inside cover 12 and the outside cover 13 are sealed as constituent members of the laminated body L.

Still further, in the above-mentioned embodiment and modifications, the electrostatic speaker 1 is configured by arranging the oscillator 111, the cushioning material layer 113, the electrode 112, the inside cover 12 and the outside cover 13 from the center to the outside in the cross-sectional view of FIG. 2; however, the combination of the constituent members of the electrostatic speaker 1 is not limited to this, but any other configurations may also be adopted, provided that such configurations are equipped with synthetic resin sheet covers that are disposed so as to cover the upper side and the lower side of the sound emitting part 11 including the two electrodes 112 disposed so as to be separated on both sides of the oscillator 111.

For example, instead of the configuration in which the two kinds of covers, that is, the inside cover 12 and the outside cover 13, are provided, a configuration in which only one cover is provided as each of upper and lower layers may be adopted, or other constituent members may also be added as the constituent members of the electrostatic speaker 1 as necessary.

Figure 9:
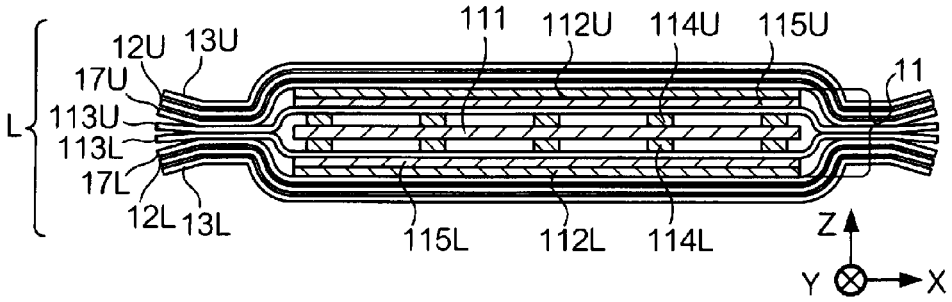
FIG. 9 is a cross-sectional view showing an electrostatic speaker according to still another modification of the embodiment of the present invention.

FIG. 9 is a cross-sectional view (a cross-sectional view taken on line A-A of FIG. 1) showing an electrostatic speaker 1 according to such a modification. In the electrostatic speaker 1 according to this modification, to the constituent members provided for the electrostatic speaker 1 shown in FIG. 2, (1) a spacer 114 between the oscillator 111 and the cushioning material layer 113, (2) a cushioning material layer 115 between the cushioning material layer 113 and the electrode 112 and (3) a cushioning material layer 17 between the electrode 112 and the inside cover 12 are respectively added and disposed.

The spacer 114 has adhesive layers on both sides and plays a role of fixing the oscillator 111 to the cushioning material layer 113 in addition to the role of serving as a spacer. Furthermore, the cushioning material layer 115 is a hot melt sheet that is melted and hardened by heating and cooling and plays a role of fixing the cushioning material layer 113 to the electrode 112 in addition to the role of serving as a cushioning material.

Furthermore, the size and shape of the cushioning material layer 115 as viewed from the Z-axis direction are almost the same as the size and shape of the oscillator 111 and the electrode 112, and the size and shape of the cushioning material layer 17 as viewed from the Z-axis direction are almost the same as the size and shape of the cushioning material layer 113, the inside cover 12 and the outside cover 13. Hence, the cushioning material layer 17 constitutes the laminated body L together with the cushioning material layer 113, the inside cover 12 and the outside cover 13, and these are sealed.

Although the present invention has been described in detail referring to the specific embodiment, it is obvious to those skilled in the art that various changes and modifications can be made without departing from the spirit and scope of the present invention.

This application is based on Japanese Patent Application (JP2011-262774) filed on Nov. 30, 2011, the contents of which are hereby incorporated by reference.

INDUSTRIAL APPLICABILITY

With the electrostatic speaker according to the present invention, an electrostatic speaker having high durability can be realized at low cost without deterioration in acoustic characteristics.

DESCRIPTION OF REFERENCE NUMERALS AND SIGNS

1 . . . electrostatic speaker, 2 . . . drive circuit, 11 . . . sound emitting part, 12 . . . inside cover, 13 . . . outside cover,

14 . . . cable, 15 . . . connector, 16 . . . glass cloth, 17 . . . cushioning material layer, 21 . . . amplifier, 22 . . . transformer, 23 . . . bias power source, 24 . . . connector, 111 . . . oscillator, 112 . . . electrode, 113 . . . cushioning material layer, 114 . . . spacer, 115 . . . cushioning material layer

The invention claimed is:

1. An electrostatic speaker comprising:

an oscillator formed of a sheet-like member and having conductivity and flexibility;

a first cushioning material layer and a second cushioning material layer, each formed of a sheet-like member and having insulation property, air permeability and elasticity;

a first electrode and a second electrode, each formed of a sheet-like member and having conductivity, air permeability and flexibility; and a first cover layer and a second cover layer, each formed of a sheet-like member and having insulation property, wherein the oscillator is disposed between the first cushioning material layer and the second cushioning material layer, the first cushioning material layer is disposed between the oscillator and the first electrode, and the second cushioning material layer is disposed between the oscillator and the second electrode, the first electrode is disposed between the first cushioning material layer and the first cover layer, and the second electrode is disposed between the second cushioning material layer and the second cover layer, a laminated body includes a plurality of layers including at least the first cover layer and the second cover layer, the laminated body includes: a first region including an outer edge end of the laminated body; and a second region inside the first region, in the second region, two adjacent layers of the plurality of layers included in the laminated body are fixed to each other, and strength at the outer edge end in the first region is higher than strength in the second region.

2. The electrostatic speaker according to claim 1, wherein, in the second region, the two adjacent layers of the plurality of layers included in the laminated body are fixed to each other by heat sealing.

3. The electrostatic speaker according to claim 1, wherein, in the outer edge end in the first region, the two adjacent layers of the plurality of layers included in the laminated body are not fixed.

4. The electrostatic speaker according to claim 1, further comprising a reinforcing layer formed of a sheet-like member and fixed to at least one layer of the plurality of layers included in the laminated body, in at least part of the first region.

5. The electrostatic speaker according to claim 1, wherein the first region includes the whole periphery of the outer edge end of the laminated body.

6. An electrostatic speaker producing method comprising:

providing an electrostatic speaker comprising:

an oscillator formed of a sheet-like member and having conductivity and flexibility;

a first cushioning material layer and a second cushioning material layer, each formed of a sheet-like member and having insulation property, air permeability and elasticity;

a first electrode and a second electrode, each formed of a sheet-like member and having conductivity, air permeability and flexibility; and a first cover layer and a second cover layer, each formed of a sheet-like member and having insulation property, wherein the oscillator is disposed between the first cushioning material layer and the second cushioning material layer, the first cushioning material layer is disposed between the oscillator and the first electrode, and the second cushioning material layer is disposed between the oscillator and the second electrode, the first electrode is disposed between the first cushioning material layer and the first cover layer, and the second electrode is disposed between the second cushioning material layer and the second cover layer, a laminated body includes a plurality of layers including at least the first cover layer and the second cover layer, and the laminated body includes: a first region including an outer edge end of the laminated body; and a second region inside the first region; and, in the second region, fixing two adjacent layers of the plurality of layers included in the laminated body to each other, wherein strength at the outer edge end in the first region is higher than strength in the second region.

* * * * *